US005959652A

United States Patent [19]

Privin

[11] Patent Number: 5,959,652

[45] Date of Patent: Sep. 28, 1999

[54] THERMAL INK RIBBON CASSETTE FOR MAILING MACHINES

[75] Inventor: David Privin, Stamford, Conn.

[73] Assignee: Pitney Bowes Inc., Stamford, Conn.

[21] Appl. No.: 08/890,788

[22] Filed: Jul. 11, 1997

[51] Int. Cl.[6] ..... B41J 33/14

[52] U.S. Cl. ..... 347/214; 400/236

[58] Field of Search ..... 347/214; 400/207, 400/208, 223, 235, 235.1, 236, 208.1, 196, 197, 693, 693.1

[56] References Cited

U.S. PATENT DOCUMENTS

| | | | |
|---|---|---|---|
| 4,705,417 | 11/1987 | Harry | 400/235 |
| 4,746,234 | 5/1988 | Harry | 400/120.01 |
| 4,767,228 | 8/1988 | Harry | 400/234 |
| 4,886,384 | 12/1989 | Harry | 400/223 |
| 5,319,392 | 6/1994 | Durst et al. | 347/212 |
| 5,524,995 | 6/1996 | Brookner et al. | 400/596 |
| 5,619,244 | 4/1997 | Manna | 347/214 |

*Primary Examiner*—David F. Yockey
*Assistant Examiner*—Anh T. N. Vo
*Attorney, Agent, or Firm*—Alberta A. Vitale; Angelo N. Chaclas; Melvin J. Scolnick

[57] ABSTRACT

A thermal ink ribbon cassette for holding an inked ribbon of indefinite length for use in a thermal transfer printing mechanism holds a spool of fresh ink ribbon which passes out of the cassette and across a thermal printing head, and then back into the cassette. The features of construction and arrangement of the cassette are such that the length of the portion of the normal feed path of envelopes through the mailing machine in which the ink ribbon and the envelopes travel coextensively is reduced to an absolute minimum to avoid unnecessary contact after printing take place. A slanted wall is provided for ensuring that the envelopes remain in their normal path of travel regardless of any tendency of the envelope to adhere to the ink ribbon after the point of normal separation, or if they are bulged and tend to jam on internal portions of the mailing machine. A rectangular opening is provided to permit manual access to the interior of the cassette housing so that the broken end of an ink ribbon can be inserted into the housing and reattached to used ribbon accumulated on the take up spool. Also, an improved anti-reverse mechanism has been provided that remains operable to prevent reverse rotation of the take up spool regardless of the physical orientation of the cassette.

8 Claims, 3 Drawing Sheets

THERMAL INK RIBBON CASSETTE FOR MAILING MACHINES

CROSS REFERENCE TO OTHER APPLICATIONS

This application discloses and claims an improvement on the invention disclosed and claimed in co-pending application Ser. No. 758,405, filed Nov. 29, 1996, and assigned to the assignee of this application.

BACKGROUND OF THE INVENTION

The present invention relates generally to the field of mailing machines, and more particularly to an improved removable and disposable cassette for use in mailing machines which encloses a disposable inked ribbon used in conjunction with a thermal ink transfer printing process by which the mailing machine prints postage indicia on envelopes.

The above referenced patent application discloses and claims a thermal ink ribbon cassette for use in a mailing machine having a postage meter which includes a printing device for printing postage indicia on envelopes passing through the mailing machine. The printing device utilizes thermal ink ribbon printing technology in which thermal ink permeated in a ribbon is heated and deposited in a selected image pattern on the surface of an envelope to form the image of a postage indicia. In its simplest form, this method involves bringing the surface of an envelope and a ribbon that is permeated with a suitable thermal transfer ink into intimate contact, and moving the envelope and ribbon combination beneath a thermal print head which has the capability of heating the inked ribbon selectively along a print line so that the ink is heated and transferred to the surface of the envelope in a desired image pattern. The thermal print head includes a plurality of minute heating elements spaced along a print line which are selectively actuated under the control of suitable software so as to heat the ribbon in a precisely controlled sequence which will produce the desired image on the envelope as the envelope and ribbon are moved together relative to the print head.

As set forth in the above referenced application, thermal ink printing technology is not new and has been successfully utilized in many different applications. But it is relatively new as applied to the printing of postage indicia on envelopes traveling through a mailing machine, and several problems described in the above referenced application were encountered and were addressed by the ink ribbon cassette invention described and claimed therein. Although most of these problems were, for the most part, satisfactorily solved by that invention, some were not entirely solved, and others grew out of that invention, and it is to the solution of these problems that the present invention is directed.

A significant remaining problem is that of breakage of the ribbon during recurring printing operations, and it was determined that the major cause of the breakage was certain conditions that occurred during an excessive amount of contact between the ribbon and the envelopes during a printing operation. There are two aspects to this problem, one being that the ribbon is relatively fragile, and occasionally envelopes are fed into the mailing machine that are wrinkled or curled due to poor manufacture or packaging, or physical or environmental characteristics, with the result that the envelopes can damage the ribbon, and unnecessary contact between the ribbon and the envelopes increases the likelihood of this happening. The other aspect is that due to the fact that the ribbon is moved from the supply spool to the take up spool solely by frictional contact with envelopes moving past the print head, it is virtually impossible to cause the ribbon and the envelopes to move at precisely the same speed, with the result that there is a minute amount of slippage between the contacting surfaces of the ribbon and the envelope. The longer these surfaces are in contact while the ink ribbon and envelopes are moving, the more slippage can occur between the surfaces, with the result that the ribbon can become unevenly wrinkled and eventually skew to one side or the other during further movement, until an edge of the ribbon contacts a portion of the mailing machine or the cassette housing and causes the ribbon to break.

It was also noted that during operation of the prior cassette, occasionally an envelope would tend to remain adhered to the ink ribbon after the ribbon had passed the point where it would normally be separated from the envelope, thereby causing the envelope to jam in the mailing machine. Also, on occasion an envelope would bulge in the middle, either due to overstuffing or physical damage to the envelope, and this would cause it to jam in the mailing machine adjacent the location where the ink ribbon is being separated from it.

Another significant problem that became apparent in the course of using of the cassettes of the prior art is that the anti-reverse mechanism of the take up spool was operable to prevent used ink ribbon from being unwound only when the cassette was in its normal upright orientation, either in its operating position within the cassette or outside of the cassette. Thus, if the cassette was held in an inverted position, or nearly so, a locking gear that was normally held engaged by gravity with a gear on the ribbon take up spool to lock that gear against reverse rotation would become disengaged from the gear, thereby permitting reverse rotation of the gear and the take up spool by pulling on the free end of the ribbon. This defeated a security feature of the cassette, the purpose of which was to prevent unscrupulous users from attempting to reuse the ribbons to obtain duplicate postage indicia for which they had not paid.

Thus, it is apparent that there is a need for further improvement of the cassette disclosed and claimed in the aforementioned prior application to eliminate the remaining problems associated therewith.

BRIEF SUMMARY OF THE INVENTION

The foregoing problems have been largely alleviated, if not entirely eliminated, by the improved thermal ink ribbon cassette of the present invention. Thus, the portion of the path of travel for envelopes through the mailing machine during which the upper surfaces of the envelopes are coextensive with the undersurface of the ink ribbon has been reduced to the absolute minimum by providing for separation of the ribbon from an envelope immediately after the ribbon and envelope leave the coextensive portion of the path of travel, thereby achieving a significant reduction in the length of the coextensive portion over prior art cassettes and accompanying reduction in the likelihood that the foregoing problems will occur. An ancillary benefit of this arrangement is a substantial increase in the amount of imprints that can be obtained from a given length of ribbon, thereby significantly reducing the purchase cost of the cassette.

To solve the ribbon repair problem, a side wall of the cassette has been provided with an access opening that will accommodate a finger of a user, and the lower portion of the cassette has been provided with a tape infeed opening so that the free end of a broken ribbon that is inserted into the opening can be grasped and reattached to the ribbon on the take up spool by adhesive tape or other suitable means without the necessity of a relatively expensive mechanical ribbon feed device built into the cassette, as was the case with the prior cassette.

Still further, the anti-reverse mechanism of the prior cassette has been redesigned to provide a suitable retaining device to prevent the anti-reverse locking gear from disengaging from the take up spool gear if the cassette is removed and the mailing machine and held in an inverted position, yet without interfering with the normal gear tooth override of these gears during ribbon take up rotation of the take up spool.

Thus, in its broader aspects, the present invention is a thermal ink ribbon cassette for holding a web of thermal ink ribbon for use in a thermal ink transfer printing mechanism of a mailing machine, the mailing machine having a path of travel for envelopes, and means defining a portion of the path of travel along which the ink ribbon and envelopes are fed coextensively past a thermal print head which transfers ink from the ribbon to the surface of the envelopes in a selected image pattern to print a postage indicia on the envelopes, said cassette comprising. In this environment, the cassette comprises a plurality of walls defining a generally rectangular housing, means in the housing disposed in spaced relationship for rotatably holding a supply spool of thermal ink ribbon and a take up spool for winding used ink ribbon thereon, and spaced apart upstream and downstream wall means in the housing adjacent a lower portion thereof defining a downwardly opening cavity adapted to receive the print head of the printing mechanism when the cassette is installed in the mailing machine. The cassette further comprise means disposed adjacent the bottom of the cavity on the side thereof adjacent the supply spool defining an exit opening from the housing for ink ribbon being withdrawn from the housing, and means disposed adjacent the lower portion of the housing and spaced from the side of the cavity adjacent the take up spool defining an entrance opening into the housing for ink ribbon being reinserted into the housing. Further, there is means disposed at the downstream one of the wall means for causing the path of movement of the ink ribbon to be directed sharply out of the portion of the path of travel in which the ink ribbon and the envelopes move coextensively, whereby the ink ribbon is removed from ink transfer contact with the envelopes at the downstream wall means to reduce the length of contact between the ink ribbon and the envelopes to the least possible distance.

In some of its more limited aspects, the means for causing the path of movement of the ink ribbon to be directed out of the coextensive portion of the path of travel comprises a portion of the means defining the entrance opening being formed as an upwardly slanting wall, the lower end thereof being joined to the lower end the downstream one of the spaced apart walls. This juncture is disposed slightly above the plane of the coextensive portion of the path of travel to permit the ink ribbon to move out of contact with the envelopes slightly in advance of the juncture of the lower end of the upwardly slanting wall and the lower end of the downstream one of the spaced apart walls. A pair of side edge mail guides formed on the bottom surface of the front and rear walls of the cassette housing assist in ensuring that the ink ribbon is separated from the surface of the envelopes by holding the envelopes down in their normal path of travel and preventing them from adhering to the underside of the ink ribbon. Further, an envelope deflector is provided to prevent any envelopes that, for one reason or another may bulge between the mail guides, from causing a jam in the mailing machine by exerting a downward force on the lead edge of an envelope that bulges upwardly, thereby forcing the envelope to remain in the normal path of travel beyond the strip off point.

Another significant feature of the invention is that the cassette is provided with means formed in one of the walls defining the generally rectangular housing adjacent to the take up spool for permitting manual access to a broken end of the ink ribbon being inserted into the entrance opening, for reattaching the broken end to accumulated ink ribbon on the take up spool, thereby permitting the broken ribbon to be effectively repaired for continued use of the unused portion of ink ribbon remaining on said supply spool. A first upwardly slanting wall is disposed adjacent the downstream end of the coextensive portion of the path of travel, and a second upwardly slanting wall is disposed adjacent the downstream end of the first upwardly slanting wall and has an upstream portion thereof underlying and parallel to a downstream portion of the first upwardly slanting wall to provide a surface for supporting the broken end of the ribbon when the broken end is manually fed through the entrance opening. The access means for permitting a user to grasp the broken end of the ribbon is an opening in the wall extending substantially thereacross and being wide enough to permit a user's finger to be inserted therethrough to grasp the broken end of the ribbon being moved along the surface of the second upwardly slanting wall.

Finally, the cassette is provided with an improved anti-reverse mechanism which prevents the take up spool from rotating in the reverse direction, which prevents used ink ribbon from being withdrawn from the take up spool, regardless of the physical orientation of the cassette, whether in or outside of the mailing machine. The mechanism includes a locking gear for a gear on the take up spool and a retainer which prevents the locking gear from becoming disengaged from the other gear even if the cassette is turned upside down.

Having briefly described the general nature of the present invention, it is a principal object thereof to provide a thermal ink ribbon cassette for use in a mailing machine which has various features of novel construction that avoid the problems and disadvantages of prior art cassettes.

Another object of the present invention is to provide a thermal ink ribbon cassette in which the length of contact between the ink ribbon and an envelope, while traveling coextensively through a portion of the path of travel of envelopes through the mailing machine, has been reduced to an absolute minimum.

Still another object of the present invention is to provide a thermal ink ribbon cassette having features of construction directed to maintaining envelopes in their normal path of travel through the mailing machine regardless of any tendency of the envelopes to adhere to the ink ribbon during separation of the ink ribbon from the envelopes, or in the event that envelopes are bent through damage or other and tend to bulge out of the normal path of travel and jam in the mailing machine.

It is another object of the present invention to provide a thermal ink ribbon cassette in which the free end of a broken ink ribbon can be manually fed into the cassette housing adjacent the take up spool and reattached to accumulated ribbon on the take up spool through an access opening provided in the cassette housing.

It is still another object of the present invention to provide a thermal ink ribbon cassette in which an anti-reverse mechanism for preventing reverse rotation of the take up spool so that used ink ribbon cannot be withdrawn from the cassette and improperly reused, which remains operable regardless of the physical orientation of the cassette.

These and other objects and advantages of the present invention will be more apparent from an understanding of the following detailed description of presently preferred embodiments of the invention when considered in conjunction with the accompanying drawings.

DETAILED DESCRIPTION OF THE INVENTION

Figure 1:
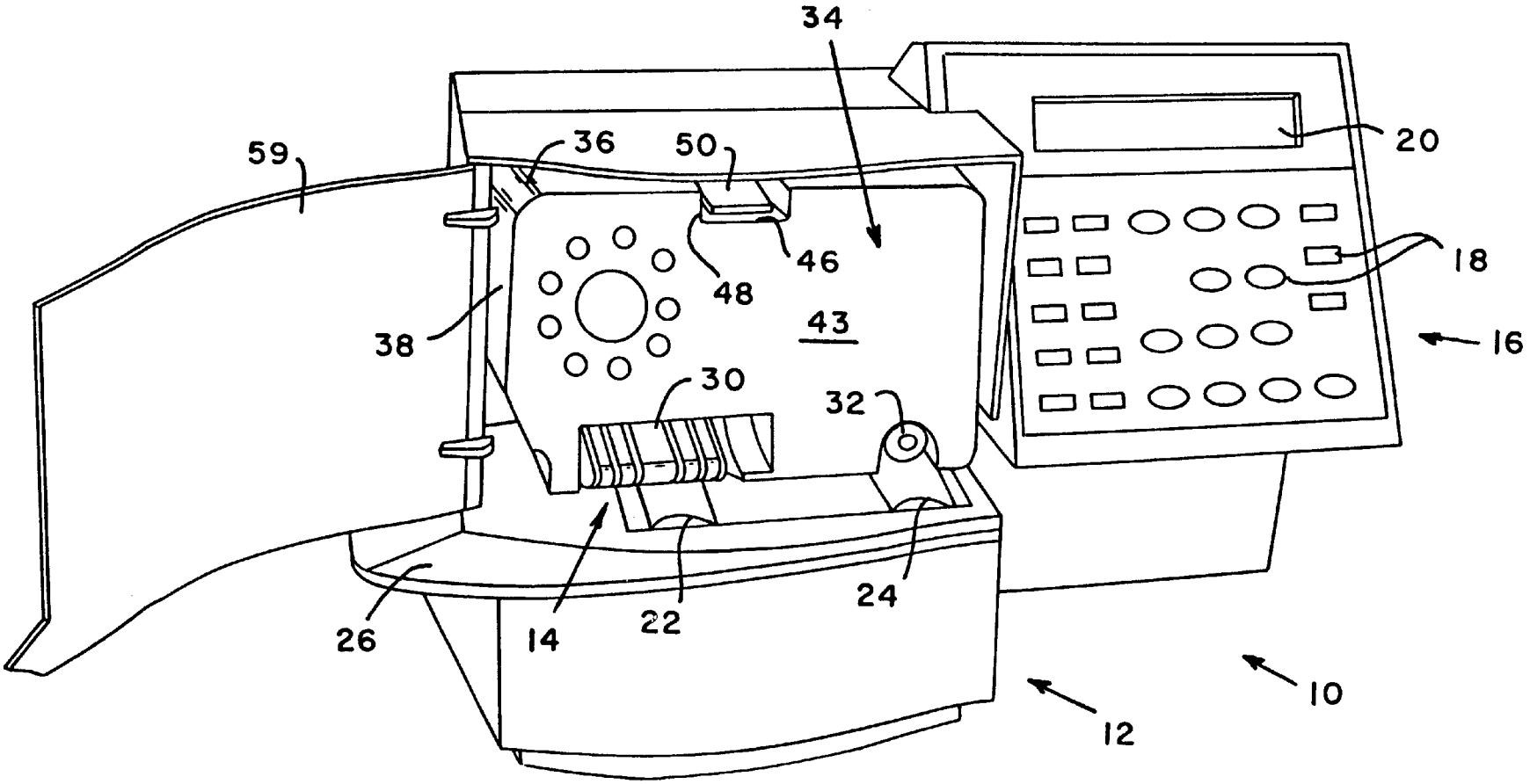
FIG. 1 is a perspective view of a mailing machine incorporating an ink ribbon cassette embodying the principles of the present invention.

Referring now to the drawings, and particularly to FIG. 1 thereof, a mailing machine, indicated generally by the reference numeral 10, includes a base unit, indicated generally by the reference numeral 12, a thermal printing unit, indicated generally by the reference numeral 14, and a data input unit, indicated generally by the reference numeral 16, which includes a plurality of push buttons 18 for entering various information, such as weight, postal zone, and other information relevant to the postage indicia which is to be printed on the envelopes. The data input unit 16 also includes an LCD display 20 for visual verification of the data entered into the unit 16.

The base unit 12 includes an envelope feeding apparatus which includes an infeed roller 22 and an eject roller 24 mounted in the base unit 12 on a suitable frame both for rotation and for alternate reciprocating movement toward and away from a feed deck 26 on which an envelope is placed by an operator preparatory to initiating a printing operation. The feed deck 26 and the infeed and outfeed rollers 22 and 24 to define a path of travel for envelopes passing through the mailing machine, along a portion of which the lower surface of an ink ribbon 28 and the upper surface of the envelopes travel coextensively. The entire envelope feeding apparatus in the base unit 12 is fully shown and described in U.S. Pat. No. 5,325,114, issued Jun. 18, 1994 to Fogle et al, and assigned to the assignee of this application. Reference is hereby made to that patent for further details of the envelope feeding apparatus, which need not be further shown or described herein since it forms no part of the present invention. For the purpose of a complete understanding of this invention, it is only necessary note that when an envelope is placed on the feed deck 26 and manually pushed against a suitable triggering device, the infeed roller 22 moves upwardly to press the upper surface of the envelope against the ink ribbon 28 shown in FIG. 2, and to press the ink ribbon 28 against the under side of a thermal print head 30. The infeed roller 22 then feeds the envelope, which in turn feeds the ink ribbon 28 through friction between the upper surface of the envelope and the lower surface of the ink ribbon 28, and also maintains the upper surface of the ink ribbon 28 in contact with the print head 30. The print head 30 is held in the mailing machine by a suitable bracket 31, the bottom edge portions 33 of which are provided with a curved surface, and which function as guides for the ink ribbon 28 at both the upstream and downstream ends of the aforementioned portion of the path of travel in which the ink ribbon 28 and the envelopes are coextensive. The print head 30, as is known in the art, is provided with a row of thermal actuators 35 adjacent the downstream edge of the print head 30 and extending laterally across the ink ribbon 28, and which are actuated to heat portions of the ink ribbon 28 so as to deposit ink on the upper surface of the envelope in a desired image pattern, as controlled by a microprocessor and suitable software. After the printing operation is completed, the leading edge of the envelope is positioned over the eject roller 24, which during printing has been in a depressed position, and which now is raised into contact with the envelope to press the envelope against a back up roller 32. Simultaneously with the upward movement of the eject roller 24, the infeed roller 22 is depressed, thereby releasing the envelope for ejection by the eject roller 24 and the back up roller 32.

Figure 2:
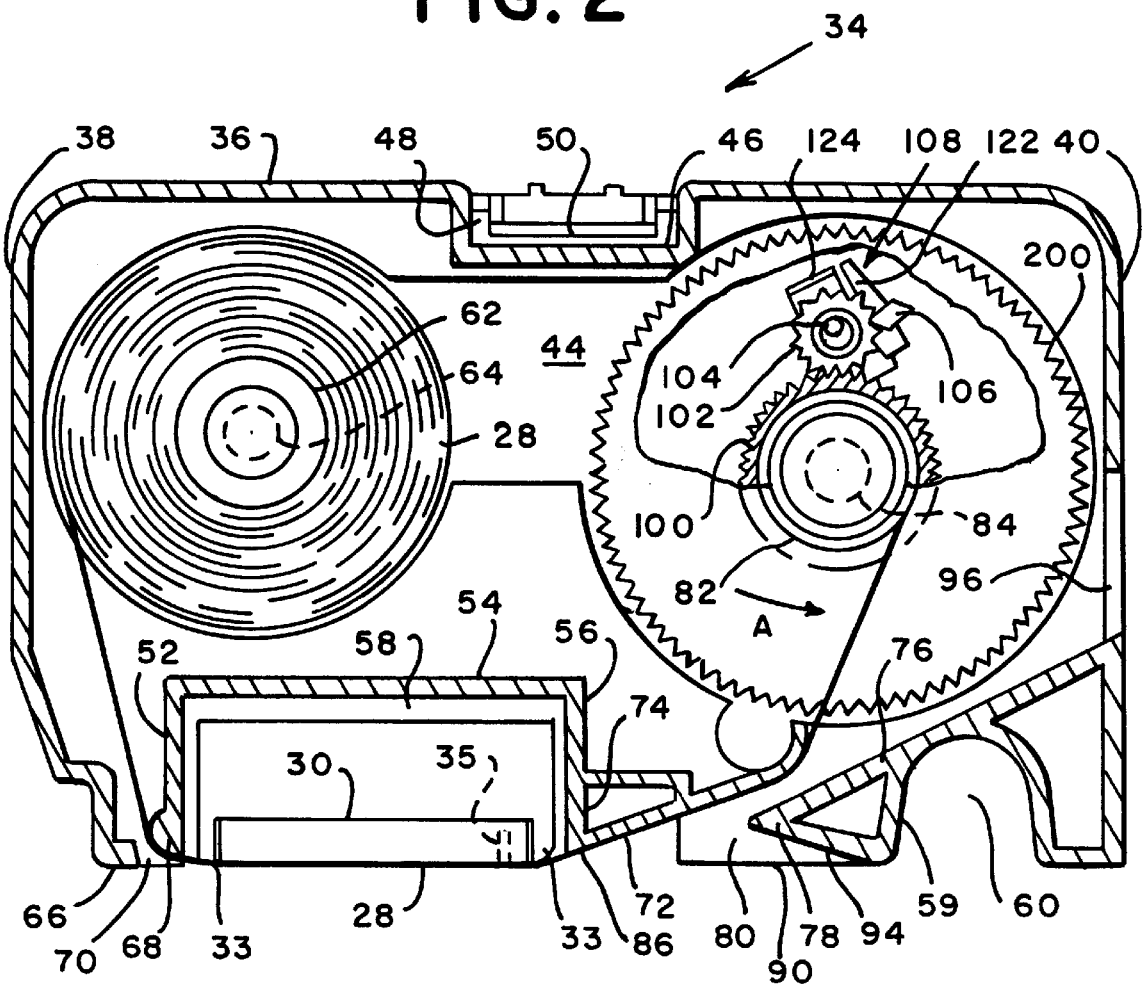
FIG. 2 is a front view of the ink ribbon cassette used in the mailing machine shown in FIG. 1, with a front wall thereof removed to reveal interior detail.

With reference now to FIGS. 1 and 2, the ink ribbon cassette of the present invention, indicated generally by the reference numeral 34, in shown in operative position in the mailing machine 10 in FIG. 1, and is shown in partial section removed from the mailing machine in FIG. 2. The cassette 34 comprises a plurality of walls, including a top wall 36, end walls 38 and 40, and front and rear walls 42 and 44, all of these walls defining a hollow housing having a generally rectangular configuration. The top wall 36 includes a downwardly projecting portion 46 which provides an upwardly opening cavity 48 to accommodate a resilient locking tab 50 by which the cassette is secured to the mailing machine. The bottom portion of the housing is enclosed by a plurality of walls, of which the walls 52, 54 and 56 define an upwardly projecting configuration which in turn defines a downwardly opening cavity 58 which accommodates the print head 30 when the cassette 34 is inserted into the mailing machine 10. The bottom portion of the housing is provided with another upwardly projecting portion 59 which defines another downwardly opening cavity 60 which accommodates the back up roller 32 when the cassette 34 is inserted into the mailing machine 10. As seen in FIG. 1, a suitable door 61 is pivotally connected to the mailing machine 10 to enclose the cassette 34 and the print head 30.

As best seen in FIG. 2, a supply spool 62 of thermal ink ribbon 28 is rotatably mounted on a suitable spindle 64 affixed to the rear wall 44 of the cassette 34. The lower end of the side wall 38 is provided with a short inturned flange portion 66 which, together with the lower edge portion 68 of the wall 52, defines a narrow opening 70 which constitutes an exit opening for the ink ribbon 28 from the interior of the cassette 34. An upwardly slanted wall 72 is disposed adjacent the bottom portion of the cassette 34 on the opposite side of the recess 58 from the exit opening 70 and is connected to the lower end 74 of the wall 56 for a purpose further described below. Still another wall 76 is disposed adjacent the bottom portion of the cassette 34 in juxtaposition with the slanted wall 72 such that the lower end 78 of the wall 76 and an upper portion of the slanted wall 72 define a narrow opening 80. The opening 80 constitutes an entrance opening for the ink ribbon 28 back into the interior of the cassette housing where the ink ribbon 28 is wound on a take up spool 82 mounted on another spindle 84 also affixed to the rear wall 44.

The forgoing construction illustrates one of the novel features of the present invention. It will be seen that the juncture of the lower end 74 of the wall 56 and the lower end of the wall 72 form an angled edge 86 which extends across the depth of the cassette 34 so that it spans the width of the ink ribbon 28. The construction is such that the edge 86 is adjacent the downstream lower edge 33 of the bracket 31. It will also be seen that the angled edge 86 of the wall 56 is disposed slightly above the downstream lower edge 33 of the bracket 31, so that the ink ribbon 28 is free to follow a path that is contiguous with the lower surface of the wall 72 and is tangent with the curvature of the downstream lower edge 33 of the bracket 31. Since the ink ribbon 28 is guided along the slanted lower surface of the wall portion 72 after passing the edge 86, the curved surface of the downstream lower edge 33 of the bracket 31 functions as a strip off point for separation of the ink ribbon 28 from the adjacent surface of the envelope to effect the least possible amount of contact between the ink ribbon 28 and the surface of the envelope beyond the printing line represented by the line of thermal actuators 35 of the print head 30.

Figure 3:
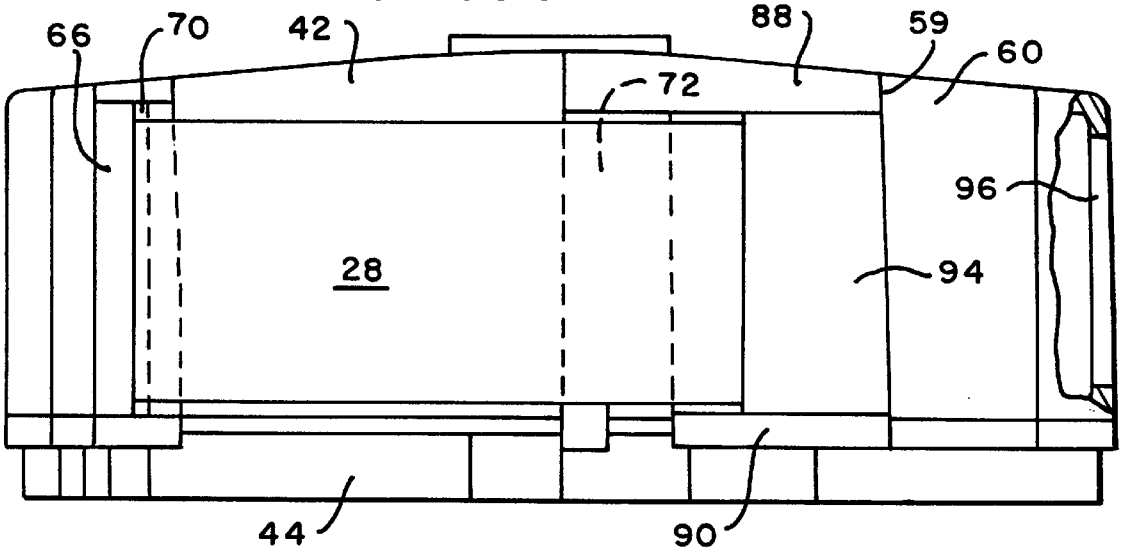
FIG. 3 is a bottom view of the ribbon cassette of the present invention showing details of the envelope guides on the bottom portion of the cassette.

As best seen in FIG. 3, the cassette 34 is provided with two additional novel features that aid in separating the ink ribbon 28 from the envelopes at the above described strip off point. One of these features is a pair of side edge mail guides 88 and 90 formed on the bottom surface of the front and rear walls 42 and 44 respectively, the guide 88 extending from the lower edge 86 of the wall 56 to approximately the upstream side of the cavity 60, while the guide 90 commences at about the midpoint of the upwardly slanting wall 72 and terminates at the same location as the guide 90. The purpose of these guides is to assist in ensuring that the ink ribbon 28 is separated from the surface of the envelopes by holding the envelopes down in their normal path of travel and preventing them from adhering to the underside of the ink ribbon 28.

The other feature is an envelope deflector which is the underside of another slanted wall 94 which is downwardly slanted in the downstream direction as viewed in FIG. 3, this wall extending from the lower end 72 of the upwardly slanting wall 76 and terminating at the juncture of this wall with the upwardly projecting portion 59 that defines the downwardly opening cavity 60, which juncture is substantially at the intersection of the wall 94 with the normal path of travel of envelopes through the mailing machine. The function of this wall is to prevent any envelopes that, for one reason or another, may bulge between the mail guides 88 and 90, and which would cause a jam in the mailing machine. The wall 94 exerts a downward force on the lead edge of an envelope that bulges upwardly, thereby forcing the envelope to remain in the normal path of travel beyond the aforementioned strip off point.

A further improvement to the cassette 34 is the provision of means formed in one of the walls defining the generally rectangular housing adjacent the take up spool for permitting manual access to a broken end of the ink ribbon 28 that is inserted into the entrance opening and for reattaching the broken end to accumulated ink ribbon on the take up spool 84. Still referring to FIGS. 2 and 3, it will be seen that the wall 76 extends from the lower end 78 adjacent the entrance opening 80 upwardly and toward the right as viewed in the figure until it intersects with the right side wall 40. The side wall 40 is provided with a generally rectangular opening 96 which extends upwardly from the intersection of the wall 74 and the side wall 40 for a distance approximately one third the height of the cassette 34. As best seen in the cut away portion of FIG. 3, the opening 96 extends horizontally for a major portion of the depth of the cassette 34 between the front wall 42 and the rear wall 44. The purpose of the opening 96 is to enable an operator of the mailing machine 10 to insert a finger through the opening and into the cassette 34 far enough to grasp the leading edge of a broken portion of the ink ribbon 28 in order to effect a repair. Thus, if the ribbon breaks for any reason as discussed above, the operator can insert the broken end through the entrance opening 80 and feed it upwardly along the upper surface of the wall 76 until it can be grasped by the operator, after which it is pulled through the opening 96 so that the operator can attach a small piece of adhesive tape which is then pressed onto the outer surface of the used ink ribbon 28 already accumulated on the spool 82, so that the ink ribbon 28 is effectively repaired and the remainder of the unused ink ribbon on the spool can be used.

Figure 6:
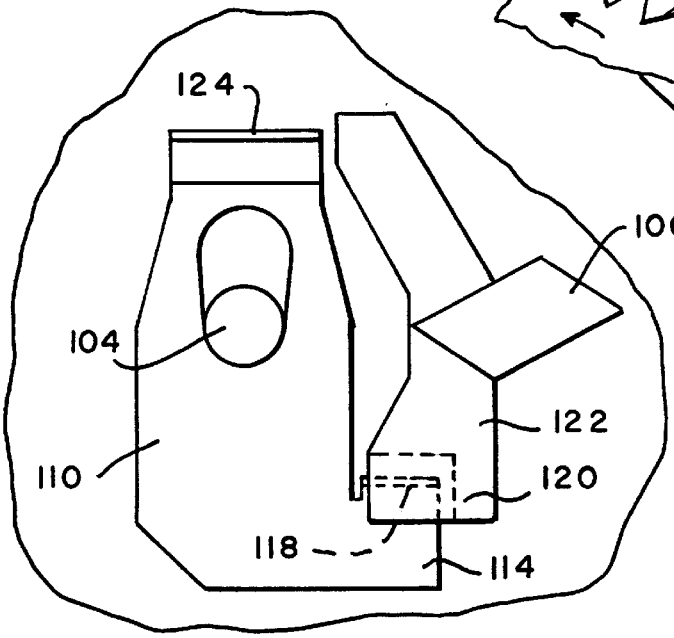
FIG. 6 is a front view of the spring retainer for the locking gear of the anti-reverse mechanism shown in FIG. 4 drawn to the same scale as in FIG. 4.

A still further improvement in the cassette 34 is the provision of an anti-reverse mechanism for the take up spool 84 which prevents reverse rotation of the take up spool 84 so that used ink ribbon 28 cannot be withdrawn from the cassette 34 and improperly reused, and which remains operable regardless of the physical orientation of the cassette 34 when removed from the mailing machine 10. The take up spool 84 is provided with a drive gear 200 and an internal gear 100 suitably affixed thereto, and a small locking gear 102 is rotatably mounted on a stub shaft 104 secured to the rear wall 44. As best seen in FIG. 6, there is sufficient play between the outside diameter of the stub shaft 104 and the inside diameter of the locking gear 102 that the locking gear 102 can shift laterally or sideways sufficiently far to engage with and disengage from an abutment dog 106 also suitably secured to the rear wall 44. The arrangement is such that during normal rotation of the spool 84 in a winding direction as indicated by the arrow A in FIG. 2, the locking gear 102 is urged toward the left so as to disengage from the abutment dog 106 and permit rotation of the spool 84. However, upon any attempt to rotate the spool 84 in the reverse direction, the locking gear 102 is urged toward the right so as to engage with the abutment dog 106 and lock up, thereby locking the gear 100 and the spool 84 from rotation in the reverse direction. The problem with the anti-reverse mechanism of the cassette shown in the above mentioned copending application is that because of the clearance between the outside diameter of the stub shaft 104 and the inside diameter of the locking gear 102, if the cassette 34 is removed from the mailing machine and turned upside down, the locking gear 102 is now urged by gravity in a direction away from the gear 100, and it moves away from the gear 100 sufficiently far to be completely disengaged from it, with the result that the spool 84 can be rotated in a reverse direction simply by pulling on the ink ribbon 28.

The improved anti-reverse mechanism of the present invention includes a spring retainer, indicated generally by the reference numeral 108 in FIG. 2 is interposed between the locking gear 102 and the rear wall 44 of the cassette 34 to prevent the locking gear 102 from moving out of engagement with the gear 100 when the cassette 34 is removed from the mailing machine and oriented in such a way that the locking gear 102 would otherwise be moved out of engagement with the internal gear 100 by gravity.

Figure 4:
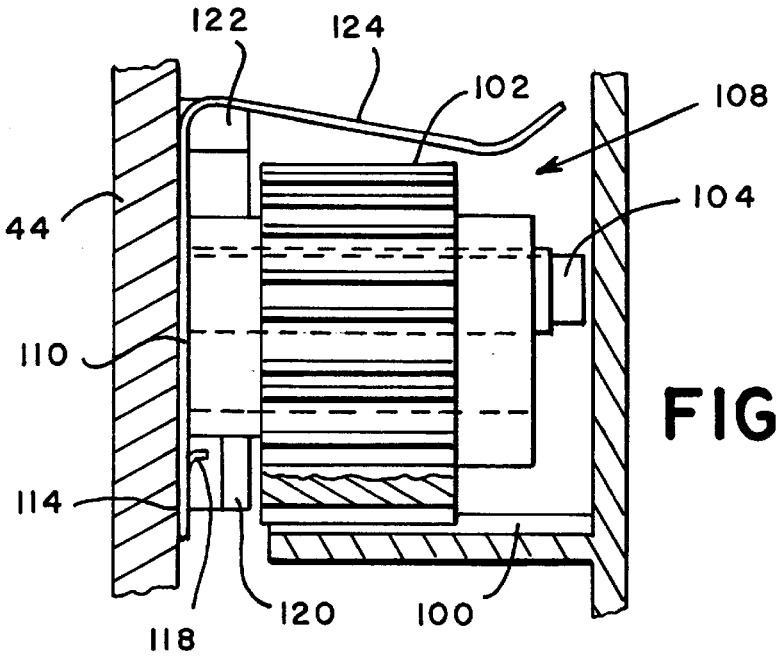
FIG. 4 is a side view, drawn to an enlarged scale, of the anti-reverse mechanism shown in FIG. 2.
Figure 5:
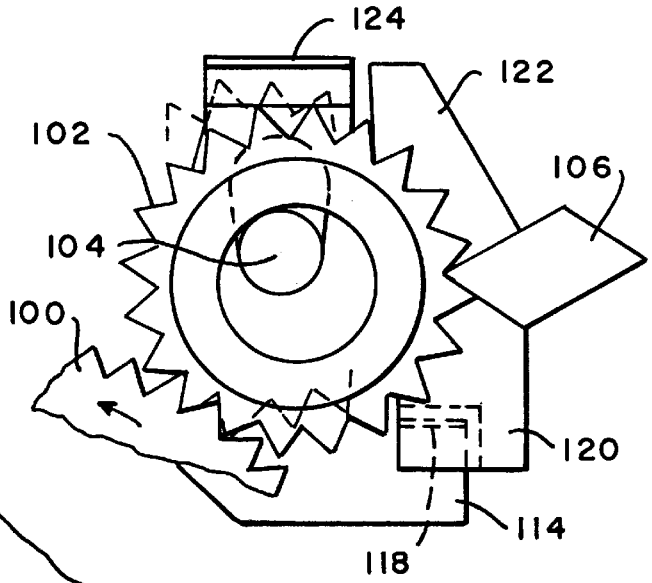
FIG. 5 is a front view of the anti-reverse mechanism shown in FIG. 4 drawn to the same scale as in FIG. 4.

Thus, it is seen that the spring retainer 108 comprises a generally elongate plate portion 110 which is adapted to lie flat against the rear wall 44 (FIG. 4), and which has an elongate slot 112 adapted to fit over the stub shaft 104. The plate portion 110 also has a laterally extending finger 114 having an outwardly bent tang 118, the tang being adapted to engage with an undercut portion 119 of the lower end 120 of an elongate rib 122 suitably secured to the wall 44 after the plate 112 is assembled to the wall 44 and moved upwardly to bring the tang 118 into the undercut portion 119 of the lower end 120 of the rib 122.

The spring retainer 108 further includes a retaining finger 124 at the upper end of the plate 110 and suitably bent to over lie the locking gear 102. It should be understood that the locking gear 102 is very light in weight, having virtually no mass, and therefore is moved back and forth sideways toward and away from the abutment dog 106 only if it has complete freedom of movement, with no external resisting force imposed on it. Therefore, the spacing between the lower surface of the retaining finger 124 and the upper edge of the teeth of the locking gear 102 is such that there is no contact between these parts when the cassette 34 is in its normal upright position within the mailing machine. Thus, the retaining finger 124 does not interfere with, or impose any resistance to, the normal sideways movement of the locking gear 102 in the course of disengaging with the abutment dog 106 when the take up spool 84 is rotating in a winding direction, and reengaging with the abutment dog 106 in the course of any attempt to rotate the take up spool 84 in the reverse direction. However, if the cassette 34 is moved from the mailing machine 10 and turned upside down, or nearly so, the locking gear 102 cannot move sufficiently far away from the gear 100 to disengage therefrom before the retaining finger 124 prevents further movement of the locking gear 102, thereby effectively preventing it from disengaging from the internal gear 100 and maintaining the take up spool 84 in a locked condition.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. A ink ribbon cassette for a mailing machine comprising:

a housing defining a substantially rectangular shape comprising a front wall, a rear wall; first and second end walls, a top wall, and a plurality of walls and surfaces defining a bottom of the housing;

a recess formed in the bottom of the housing for accommodating a print head and a print head bracket when the ink ribbon cassette is inserted in the mailing machine, the recess comprising a top wall and first and second side walls;

a supply spool rotatably mounted in the housing;

an ink ribbon rotatably mounted on the supply spool;

an exit opening defined in the bottom of the housing adjacent to the first side wall of the recess and the first end wall of the cassette, the exit opening for accommodating the exiting of the ink ribbon from the ink ribbon cassette;

an entrance opening defined in the bottom of the housing adjacent to the second side wall of recess, the entrance opening comprising:

an upwardly slanted wall extending between the front and rear walls of the housing and at a lower end connecting to a lower end of the second side wall of the recess to form a juncture; whereby the juncture of the upwardly slanted wall and the second side wall is disposed slightly above a lower edge of the print head bracket; and whereby the ink ribbon follows a path that is contiguous with the upwardly slanted wall, and is directly sharply out of a path of travel of an envelope, and the lower edge of the print head bracket functions as a strip off point for separation of the ink ribbon from the envelope; and a take up spool rotatably mounted in the housing for collecting the ink ribbon after it completes a path that is contiguous with the upwardly slanted wall.

2. The ink ribbon cassette as claimed in claim 1 further comprising:

a cavity disposed on the bottom of the housing adjacent to the second end wall of the cassette, the cavity for accommodating a roller of the mailing machine;

a first side edge mail guide disposed along a portion of the front wall of the cassette, the first side edge mail guide extending from approximately a midpoint of the upwardly slanted wall to an upstream side of the cavity; and a second side edge mail guide disposed along a portion of the rear wall of the cassette, the second side edge mail guide extending from the lower end of the second side wall of the cassette to the upstream side of the cavity;

whereby the first and second side edge mail guides maintain the envelope in the path of travel through the mailing machine as the ink ribbon is separated from the envelope.

3. The ink ribbon cassette as claimed in claim 2 further comprising:

a downwardly slanted wall, the downwardly slanted wall slants downwardly in a downstream direction and extending between the front and rear walls of the housing, at an upper end the downwardly slanted wall is spaced apart from approximately the midpoint of the upwardly slanted wall to further define the entrance opening, at a lower end the downwardly slanted wall connects to the upstream side of the cavity;

whereby the downwardly slanting wall exerts a downward force on the leading edge of the envelope thus maintaining the envelope in a normal path of travel through the mailing machine.

4. The ink ribbon cassette as claimed in claim 3 further comprising a rectangular opening in the side wall of the cassette adjacent to the take up spool comprising a top edge, a bottom edge, a front edge and a rear edge; and a second upwardly slanted wall extending from the upper end of the downwardly slanted wall to the end wall of the cassette at the bottom edge of the rectangular opening;

whereby when the ink ribbon becomes broken, a broken end of the ink ribbon can be inserted by a user into the entrance opening and guided along the second upwardly slanted wall to the rectangular opening where it can be manually accessed by the user and fastened with adhesive the a take up spool.

5. The ink ribbon cassette as claimed in claim 4 further comprising:

an internal gear having teeth therearound and secured to the take up spool;

a locking gear having teeth therearound and mounted on the cassette above the internal gear so that the teeth of the second gear mesh with the teeth of the internal gear, and the second gear mounted for limited lateral movement relative to the internal gear while the teeth of both the gears remain meshed;

an abutment dog mounted on the cassette adapted to be engaged with the second gear to prevent rotation of the second gear when the take up spool is rotated in a reverse direction; and a spring retainer interposed between the locking gear and the rear wall of the cassette whereby the locking gear is prevented from moving away from the internal gear under the influence of gravity if the ink ribbon cassette is turned so that the top wall faces down so that the locking gear is no longer above the internal gear.

6. The ink ribbon cassette as claimed in claim 1 further comprising:

an internal gear having teeth therearound and secured to the take up spool;

a locking gear having teeth therearound and mounted on the cassette above the internal gear so that the teeth of the second gear mesh with the teeth of the internal gear, and the second gear mounted for limited lateral movement relative to the internal gear while the teeth of both the gears remain meshed;

an abutment dog mounted on the cassette adapted to be engaged with the second gear to prevent rotation of the second gear when the take up spool is rotated in a reverse direction; and a spring retainer interposed between the locking gear and the rear wall of the cassette whereby the locking gear is prevented from moving away from the internal gear under the influence of gravity if the ink ribbon cassette is turned so that the top wall faces down so that the locking gear is no longer above the internal gear.

7. A ink ribbon cassette for a mailing machine comprising:

a housing defining a substantially rectangular shape comprising a front wall, a rear wall; first and second end walls, a top wall, and a plurality of walls and surfaces defining a bottom of the housing;

a recess formed in the bottom of the housing for accommodating a print head and a print head bracket when the ink ribbon cassette is inserted in the mailing machine, the recess comprising a top wall and first and second side walls;

a supply spool rotatably mounted in the housing;

an ink ribbon rotatably mounted on the supply spool;

an exit opening defined in the bottom of the housing adjacent to the first side wall of the recess and the first end wall of the cassette, the exit opening for accommodating the exiting of the ink ribbon from the ink ribbon cassette;

an entrance opening defined in the bottom of the housing adjacent to the second side wall of recess, the entrance opening comprising:

an first upwardly slanted wall extending between the front and rear walls of the housing and at a lower end connecting to a lower end of the second side wall of the recess to form a juncture; whereby the juncture of the upwardly slanted wall and the second side wall is disposed slightly above a lower edge of the print head bracket; and whereby the ink ribbon follows a path that is contiguous with the upwardly slanted wall, and is directed sharply out of a path of travel of an envelope and the lower edge of the print head bracket functions as a strip off point for separation of the ink ribbon from the envelope; and a take up spool rotatably mounted in the housing for collecting the inked ribbon after it completes a path that is contiguous with the upwardly slanted wall;

a cavity disposed on the bottom of the housing adjacent to the second end wall of the cassette, the cavity for accommodating a roller of the mailing machine;

a first side edge mail guide disposed along a portion of the front wall of the cassette, the first side edge mail guide extending from approximately a midpoint of the upwardly slanted wall to an upstream side of the cavity;

a second side edge mail guide disposed along a portion of the rear wall of the cassette, the second side edge mail guide extending from the lower end of the second side wall of the cassette to the upstream side of the cavity;

whereby the first and second side edge mail guides maintain the envelope in its normal path of travel through the mailing machine as the ink ribbon is separated from the envelope a downwardly slanted wall, the downwardly slanted wall slants downwardly ir a downstream direction and extending between the front and rear walls of the housing, at an upper end the downwardly slanted wall is spaced apart from approximately the midpoint of the upwardly slanted wall to further define the entrance opening, at a lower end the downwardly slanted wall connects to the upstream side of the cavity;

whereby the downwardly slanting wall exerts a downward force on the leading edge of the envelope thus maintaining the envelope in a normal path of travel through the mailing machine;

a rectangular opening in the side wall of the cassette adjacent to the take up spool comprising a top edge, a bottom edge, a front edge and a rear edge; and a second upwardly slanted wall extending from the upper end of the downwardly slanted wall to the end wall of the cassette at the bottom edge of the rectangular opening;

whereby when the ink ribbon becomes broken, a broken end of the ink ribbon can be inserted by a user into the entrance opening and guided along the second upwardly slanted wall to the rectangular opening where it can be manually accessed by the user and fastened with adhesive to the take up spool.

8. The ink ribbon cassette as claimed in claim 7 further comprising:

an internal gear having teeth therearound and secured to the take up spool;

a locking gear having teeth therearound and mounted on the cassette above the internal gear so that the teeth of the second gear mesh with the teeth of the internal gear, and the second gear mounted for limited lateral movement relative to the internal gear while the teeth of both the gears remain meshed;

an abutment dog mounted on the cassette adapted to be engaged with the second gear to prevent rotation of the second gear when the take up spool is rotated in a reverse direction; and a spring retainer interposed between the locking gear and the rear wall of the cassette whereby the locking gear is prevented from moving away from the internal gear under the influence of gravity if the ink ribbon cassette is turned so that the top wall faces down so that the locking gear is no longer above the internal gear.

* * * * *